US009107517B1

(12) United States Patent
Moss

(10) Patent No.: US 9,107,517 B1
(45) Date of Patent: Aug. 18, 2015

(54) FOLDABLE DISPLAY SUPPORT STAND

(71) Applicant: Geoffrey Alan Moss, Maple (CA)

(72) Inventor: Geoffrey Alan Moss, Maple (CA)

( * ) Notice: Subject to any disclaimer, the term of this patent is extended or adjusted under 35 U.S.C. 154(b) by 0 days.

(21) Appl. No.: 14/120,867

(22) Filed: Jul. 8, 2014

(51) Int. Cl.
*A47F 5/02* (2006.01)
*A47F 5/11* (2006.01)

(52) U.S. Cl.
CPC ..... *A47F 5/116* (2013.01); *A47F 5/118* (2013.01)

(58) Field of Classification Search
CPC ..... B65D 5/22; B65D 5/18; B65D 5/20; A47F 5/112; A47F 5/114; A47F 5/116; A47B 47/06; G06F 5/00
USPC ..... 211/135, 149, 59.2, 72, 132.1; 248/174
See application file for complete search history.

(56) References Cited

U.S. PATENT DOCUMENTS

| | | | | | |
|---|---|---|---|---|---|
| 2,298,427 | A | * | 10/1942 | Slanhoff | 211/135 |
| 2,307,992 | A | * | 1/1943 | Calhoun et al. | 206/733 |
| 2,344,182 | A | * | 3/1944 | Taylor | 206/320 |
| 2,571,301 | A | * | 10/1951 | Slanhoff | 211/135 |
| 2,797,815 | A | * | 7/1957 | Gorman | 211/72 |
| 3,009,622 | A | * | 11/1961 | Leone | 206/485 |
| 3,141,555 | A | * | 7/1964 | Funke et al. | 211/135 |
| 4,330,102 | A | * | 5/1982 | Gebhardt et al. | 248/459 |
| 4,396,118 | A | * | 8/1983 | Watson | 206/424 |
| 5,351,882 | A | * | 10/1994 | Krautsack | 206/45.26 |
| 5,560,692 | A | * | 10/1996 | Smith | 312/114 |
| D389,341 | S | * | 1/1998 | Danner et al. | D6/682 |
| 6,105,796 | A | * | 8/2000 | Buchanan et al. | 211/128.1 |
| 6,234,433 | B1 | * | 5/2001 | Maglione | 248/174 |
| 6,488,245 | B1 | * | 12/2002 | Maglione | 248/174 |
| 6,918,491 | B2 | * | 7/2005 | Moss et al. | 206/764 |
| 6,929,117 | B1 | * | 8/2005 | Cohen | 206/45.25 |
| 6,966,447 | B2 | * | 11/2005 | Hiltke et al. | 211/132.1 |
| 8,136,678 | B2 | * | 3/2012 | Moss | 211/73 |
| 2006/0226209 | A1 | * | 10/2006 | Peniche et al. | 229/156 |
| 2008/0067301 | A1 | * | 3/2008 | Moss et al. | 248/174 |
| 2013/0026329 | A1 | * | 1/2013 | Lane et al. | 248/459 |

* cited by examiner

*Primary Examiner* — Joshua Rodden
*Assistant Examiner* — Kimberly S Wright
(74) *Attorney, Agent, or Firm* — David W. Wong

(57) ABSTRACT

A foldable display support stand is foldable easily and readily into a folded collapsed condition. The stand has a foldable pedestal panel foldable in a horizontal to maintain the stand in a stable erected condition. A pivotal brace extending between the front panel and the rear panel is operative to an extended condition to push the side panels outwards in the erection of the stand, and they are pullable outwards and downwards to initiate the folding operation together with the folding of a pedestal panel upwards to fold the stand into a folded collapsed condition. An elastic cord is connected between the rear panel and the pedestal panel to facilitate the automatic erection of the folded stand to the erected condition.

7 Claims, 4 Drawing Sheets

FOLDABLE DISPLAY SUPPORT STAND

BACKGROUND OF THE INVENTION

1. Field of the Invention

This invention relates to a display support stand applicable for directly supporting a merchandise, a merchandise containing case, or a planar board having a pictorial representation of a merchandise, and particularly relates to a support stand constructed from a unique design pattern provided on a single cardboard or corrugated board. The stand is easily foldable to a collapsed condition for storage and transportation and is readily erectable from the folded collapsed condition to the erected condition either manually or automatically.

2. Background Art

Display stands are widely employed for displaying merchandise and/or advertising pictorial boards showing the merchandise particularly in retail facilities. Merchandise display stands made of cardboard or corrugated board are cost effective to fabricate and transport, and convenient to use. Such display stands are commonly made from a design pattern provided on a single sheet material such as a cardboard or corrugated board. The pattern is cut or stamped out from the sheet and the pattern is then folded along various pre-arranged fold lines to form the stand in the erected condition. The stand may either have an A-frame with front and back panels sloping upwards from a relatively large rectangular bottom base which maintains the stand to rest stably on the ground when the stand is in the erected condition. Some stands may have a foldable front pedestal for supporting a merchandise show case or by placing the merchandise directly on the pedestal. However, due to the bulkiness of the sheet material and the relatively large dimensions of the design, many such stands are usually difficult and time consuming to assemble. Furthermore, they are considerably difficult to fold to a collapsed condition for storage and transportation and it is also often problematic to unfold them from the folded condition to the erected condition.

Some stands incorporate elastic cords which are stretched to the tension condition when the stand is in the folded condition so that the stand may be erected automatically by mainly allowing the elastic cords to pull the various parts of the folded structure to unfold so as to erect the stand in a self pop-up manner. The incorporation of elastic cords in the stand often renders the stand very awkward and relatively difficult to fold into the folded condition from the erected condition because of the necessity of having to fold the various parts while maintaining the elastic cords connected to these parts in the tensioned condition.

Another problem with the foldable cardboard stand is that the cardboard inherently retains its folded condition after it has been folded for some time such that it becomes difficult to unfold even with the tension force provided by the elastic cords. For this reason, many so called self-erectable stands are not effective in the self-erecting operation. Some foldable cardboard stands are provided with a pivotable brace panel within the stand to force the folded stand to unfold. The brace panel is folded against the front or rear panel within the stand when the latter is in the collapsed and in the folded condition. It can be pivoted to the horizontal position during the erecting operation of the stand to force the front and rear panels to move apart from one another so as to ensure that the stand would effectively unfold from the folded collapsed condition. However, such additional pivotable brace panel are not integrally formed with the stand but is an individual separate part which must be attached at one edge to the inner wall of the front or rear panel of the stand with adhesive during or after the stand has been assembled. Such additional attaching operation with adhesive is labor intensive and time consuming to carry out, and it greatly increases the fabrication time of the stand. Still furthermore, the pivotable brace renders the folding operation of the stand awkward and difficult to carry out since the brace must be first manually folded pivotally to abut the front or rear panel of the stand and then with it held in the folded condition while the stand is being folded.

Another long suffered problem with foldable stand is that the walls of its base lacks rigidity such that they are unable to support the weight of attachments mounted to the stand during use; and particularly the integrity or the side walls of the base will deteriorate quickly after the stand has been repeatedly folded and unfolded several times thus rendering the stand useless. Some stands have attempted to resolve the problem by providing side walls double-folded inward at the lower edges so as increase their rigidity. However, the double-folded side walls require additional fabrication processes and they also render the folding and unfolding operations of the stand very difficult and unwieldy.

SUMMARY OF THE INVENTION

It is a principal object of the present invention to provide a foldable display support stand which is readily erectable and easily foldable into the folded condition and it can be effectively unfolded into the erected condition or folded to the collapsed condition.

It is another object of the present invention to provide a foldable display support stand having an integrally formed pivotable brace.

It is another object of the present invention to provide a foldable stand having a pivotable brace which facilitates not only the unfolding operation but also the folding operation of the stand.

It is still another object of the present invention to provide a foldable and automatically erectable merchandise display stand with an automatically erectable pedestal.

BRIEF DESCRIPTION OF THE DRAWINGS

The present invention will now be described in more detail according to a preferred but non-limiting embodiment and with reference to the accompanying illustrations; wherein.

DETAILED DESCRIPTION OF THE PREFERRED EMBODIMENTS

Figure 1:
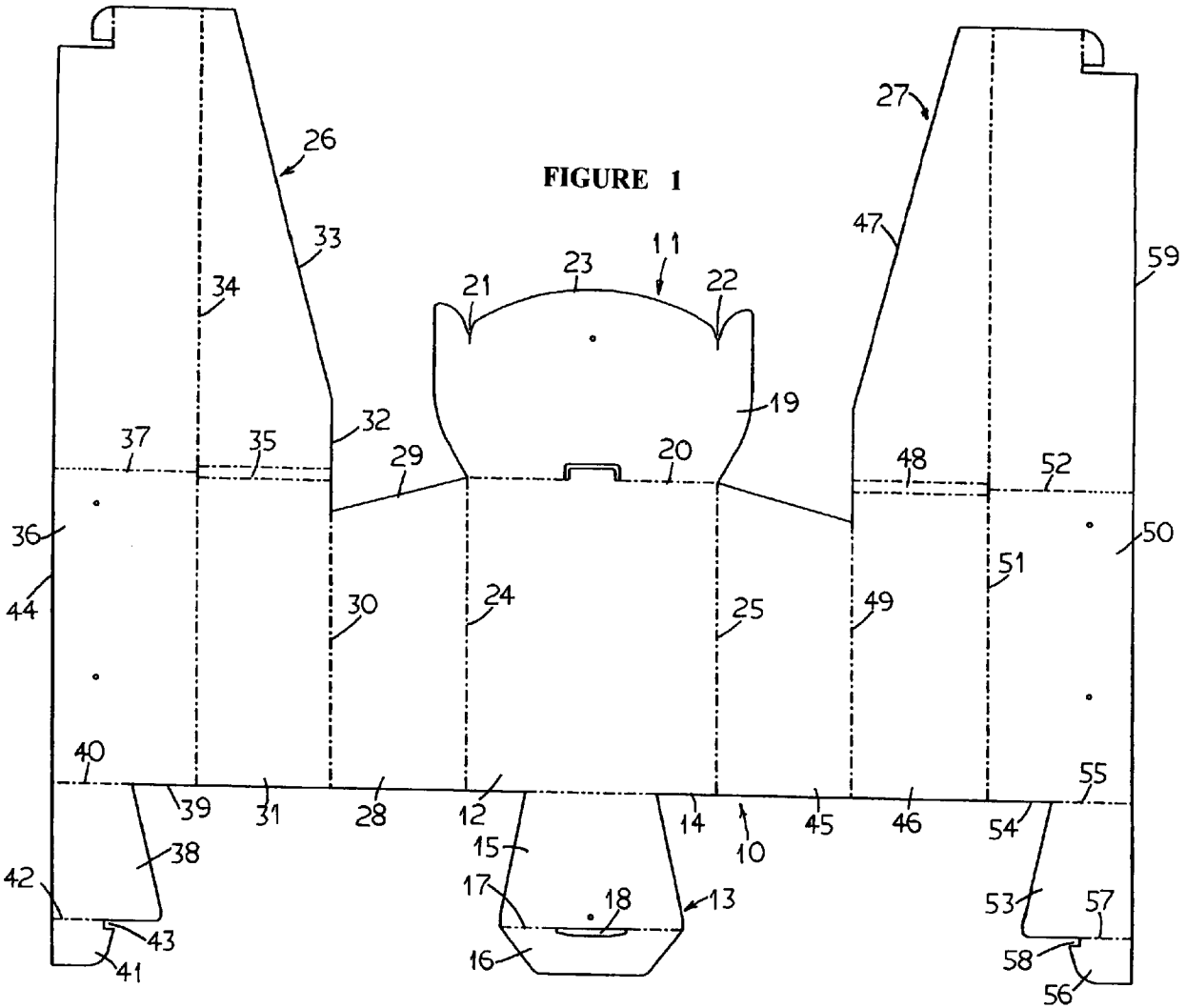
FIG. 1 is a perspective view of the design pattern provided on a cardboard or corrugated board for forming the display stand of the present invention.
Figure 2:
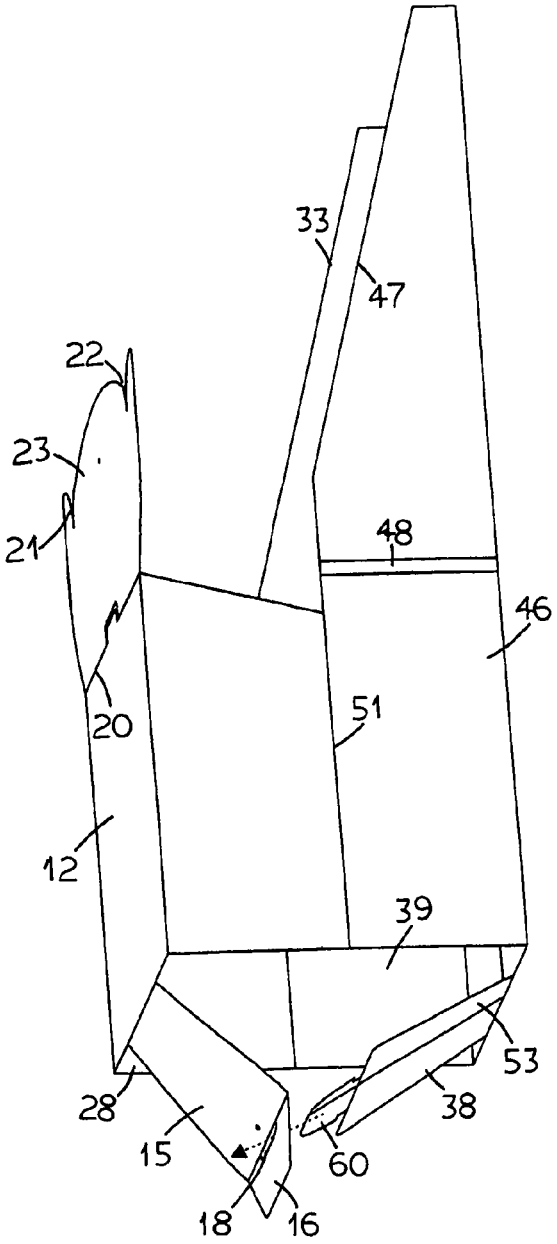
FIG. 2 is a perspective side and bottom perspective view of the stand of the present invention initially folded along fold lines in the fabrication of the stand of the present invention.

With reference to the drawings, the display stand 10 of the present invention is formed by providing a geometrical FIG. 11 as shown in FIG. 1, on a single cardboard or a corrugated paper board. The FIG. 11 has a rectangular center panel 12 which has the selected front dimensions of the display stand. A hexagonal panel 13 extends outwards from the lower edge 14 of the center panel 12. The hexagonal panel 13 consists of a trapezoidal panel 15 located adjacent to the center panel 12 from the common side edge 14. A free end trapezoidal panel 16 extends from the other edge of the trapezoidal panel 15 and located distal to the center panel 12. The trapezoidal panel 15 and the free end trapezoidal panel 15 shares a common edge 17. A transverse slot 18 is formed at the common edge 17. The hexagonal panel 13 is foldable relative to the center panel 12 along the common side edge 14. A pedestal panel 19 extends outwards from the upper edge 20 of the center panel 12 and it is foldable relative to the center panel 12 along the common edge 20. The pedestal panel 19 preferably has a wider width than the center panel 12. Two opened slots 21 and 22 are formed at the free edge 23 of the pedestal panel 19. The distance between the opened slots 21 and 22 is equal to the distance between the left vertical side edge 24 and the right vertical side edge 25. The outer free edge 23 preferably has an aesthetic round curvature.

A first geometric pattern 26 and a second geometric pattern 27 extend outwards respectively from the vertical side edges 24 and 25 of the center panel 12. The geometric pattern 26 and geometric pattern 27 are mirror images of one another. The geometric pattern 26 consists of a generally rectangular left front side panel 28 extending outwards from a vertical common side edge 24 with the center panel 12. The width of the rectangular left front side panel 28 is equal to half the selected depth of the subsequently erected stand and it is equal to the distance between the upper edge 20 of the center panel 12 and the inner end of the opened slot 21. The upper edge 29 of the left front side panel 28 is preferably sloping downwardly towards its left side edge 30. A trapezoidal left rear side panel 31 extends outwards from the common left vertical side edge 30 of the left front side panel 28. The left rear side panel 31 has a generally rectangular lower portion with a lower right side edge common with the left side edge 30 of the left front side panel 28 and an upper extension vertical side edge 32 extending a short distance above the top edge 29 of the left front side panel 28. The upper right side edge 33 of the left rear side panel 31 slopes upwardly and outwardly towards its left vertical side edge 34. The width of the left rear side panel 31 is equal to the width of the left front side panel 28. A horizontal fold line, and preferably a horizontal double fold line 35 is formed in the left rear side panel 31. The distance between the horizontal double fold line 35 and the bottom edge of the left rear side panel 31 is equal to the distance between the top edge 20 and the bottom edge of the center panel 12. A rectangular left rear panel 36 extends outwards from the left vertical side edge 34 of the left rear side panel 31. A transverse fold line 37 is formed in the left rear panel 36 at a location aligned with the double fold line 35 of the left rear side panel 31. The width of the left rear side panel 31 is slightly wider than half the width of the center panel 12.

A trapezoidal panel 38 extends from the lower edge 20 of the left rear panel 36 and its top edge 40 is common to a portion of the lower edge 20 of the left rear panel 36.

A generally trapezoidal shape tab 41 extends downwards from a portion of the left lower edge 42 of the trapezoidal panel 38, and a cut out is formed at its upper right corner immediately adjacent to the trapezoidal panel 38.

The left rear panel 36 and the trapezoidal panel 38 as well as the trapezoidal tab 41 have a common vertical left side edge 44 which forms the left side edge of the geometric pattern 26.

Similarly, the geometric pattern 27 consists of a right front side panel 45 having dimensions and a mirror image of the left front side panel 28. The right front side panel 45 extends rightward from the vertical right side edge 25 of the center panel 12. A right rear side panel 46 extends to the right of the right front side panel 45 and it has dimensions and a mirror image of the left front side panel 31 with a sloping upper left edge 47. A double fold line 48 aligned with the double fold line 35 of the left rear side panel 31. The right rear panel 46 has a common vertical side edge 49 with the right front side panel 45.

A right rear panel 50 having dimensions and a mirror image of the left rear panel 36 extends from the right vertical aide edge 51 of the right rear panel 46. A horizontal transverse fold line 52 aligned with the horizontal fold line 37 is formed in the right rear panel 50.

A trapezoidal panel 53 having dimensions and a mirror image of the trapezoidal panel 38 extends downwards from a portion of the bottom edge 54 of the right rear panel 50, and it is foldable along its top edge 55 relative to the right rear panel 50.

A trapezoidal tab 56 having dimensions and a mirror image of the trapezoidal tab 41 extends from the right bottom edge portion 57 of the trapezoidal panel 53 and a cut out 58 is formed at its upper left corner immediately adjacent to the trapezoidal panel 53.

The right rear panel 50 and the trapezoidal panel 53 as well as the trapezoidal tab 56 have a common vertical right side edge 59 which forms the right edge of the geometric pattern 27.

Figure 3:
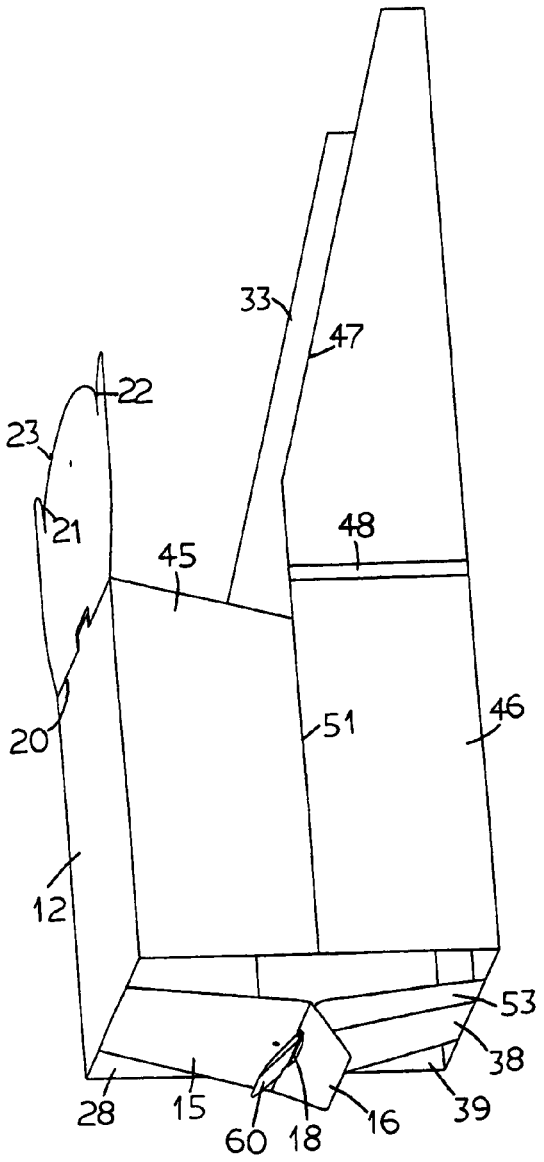
FIG. 3 is a perspective side and bottom perspective view of the stand showing the formation of integral brace by the engagement of two foldable panels relative to the front center panel and the rear panel.
Figure 4:
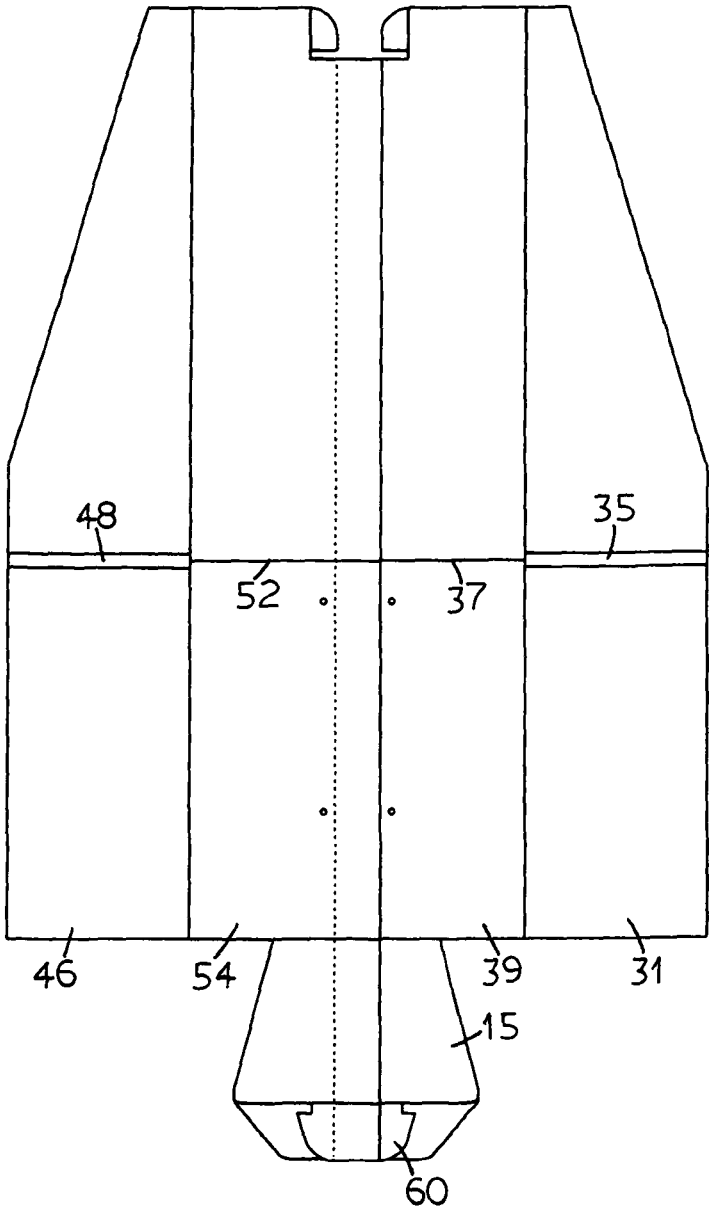
FIG. 4 is a perspective rear view of the stand in a partially folded condition with the rear panel folded to lie juxtaposed to the front panel.

In assembling the display stand, the left geometric pattern 26 and the right geometric patter 27 are folded rearwards relative to the center panel 12 along the vertical side edges 24 and 25 so that the left front panel 28 and the left rear panel 31 in combination form the left side panel of the stand, while the right front panel 45 and the right rear panel 46 in combination form the right side panel of the stand. The left rear panel 36 and the right rear panel 50 are then folded rearwards with a vertical free edge portion overlapping one another as best shown in FIG. 4 to form the rear panel of the stand. The trapezoidal tabs 41 and 56 are then folded along edges 42 and 57 towards and overlapping one another to form a trapezoidal tab 60 with the width between the two cut outs 43 and 58 equal to the width of the transverse slot 18 formed in the hexagonal panel 13. The overlapping trapezoidal tabs are then forcefully inserted into the transverse slot 18 to form a pivotal brace at the bottom of the stand and directly connected to and abutting the lower edges of the side walls of the base as best shown in FIG. 3, therefore forming the pivotal brace integrally without having to attach these parts to one another and to the front and rear panels of the stand with adhesive in separate time-consuming operations.

The pedestal panel 19 is then folded backward and downward to rest on the top edges of the left front panel 28 and right front panel 45 with the open slots 21 and 22 at the front edge 23 of the pedestal panel 19 snugly engage with the vertical edge 32 and 49 of the left front panel 31 and right front panel 46 respectively. The pedestal panel 19 is sloping slightly rearwardly and downwards due to resting on the sloping top edges of the left front panel 28 and right front panel 45. The upper front edges of the stand also slope upwardly and rearwardly due to the sloping upper edges of the left rear panel 31 and the right rear panel 46 such that a display item placed on the pedestal may rest safely and securely on the pedestal 19 and the sloping upper edges of the left rear panel 31 and the right rear panel 46.

The stand may be quickly and readily folded to a collapse condition, by pulling the pivotal brace formed by the engagement between the overlapping trapezoidal panels 38 and 53 downward and outward from the bottom end of the stand while folding the pedestal panel upwards to disengage it with the left rear panel 31 and right rear panel 46 with the side panels of the stand folding inwards towards one another along the vertical side edges 30 and 49 until the left rear side panel 31 and the right rear side panel 46 lie juxtaposed to the left rear panel 36 and the right rear panel 50 respectively with the pedestal panel 19 in the raised position and lying over the left rear panel 36 and right rear panel 50 to form the collapsed folded condition as shown in FIG. 4. The front and rear panels of the stand are pulled by the pivotal brace to fold against one another when the latter is being pulled downward and outward of the bottom of the stand. The stand in this folded condition may be further folded along the fold line 20 and the double fold lines 35 and 48 as well as the transverse fold lines 37 and 52 to form a totally collapsed condition for convenient storage and transportation.

The stand in the collapsed condition may be unfolded and erected readily and quickly by again unfolding along the fold line 20 and then pushing the pivotal brace inwards forcing the side panels to unfold back to the erected condition with the pivotal brace now positioned horizontally between the front and rear panels of the stand to maintain the latter in the erected condition. The pedestal panel 19 may then be folded downwards until its open slots 21 and 22 engage with the side edges 32 and 49 of the left rear panel 31 and right rear panel 46 to maintain further the stand in the rigid erected condition. Moreover, since the pivotal brace is directly connected to and formed from the lower edges of the side walls of the base, they provide added rigidity to the side walls of the base without requiring the problematic double-folded lower edge construction of the base side walls as in the known stands. Therefore, the pivotal brace not only renders the folding operation but also the unfolding operation to be carried out effectively and readily as well as provided rigidity to the side walls of the base.

Figure 7:
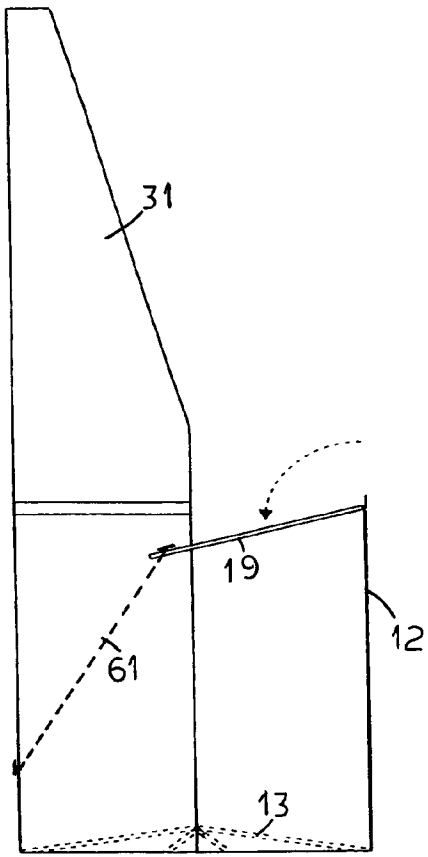
FIG. 7 is a side perspective view of the stand in the fully erected condition and with an elastic cord connected between the rear panel and the free end portion of the pedestal panel.
Figure 6:
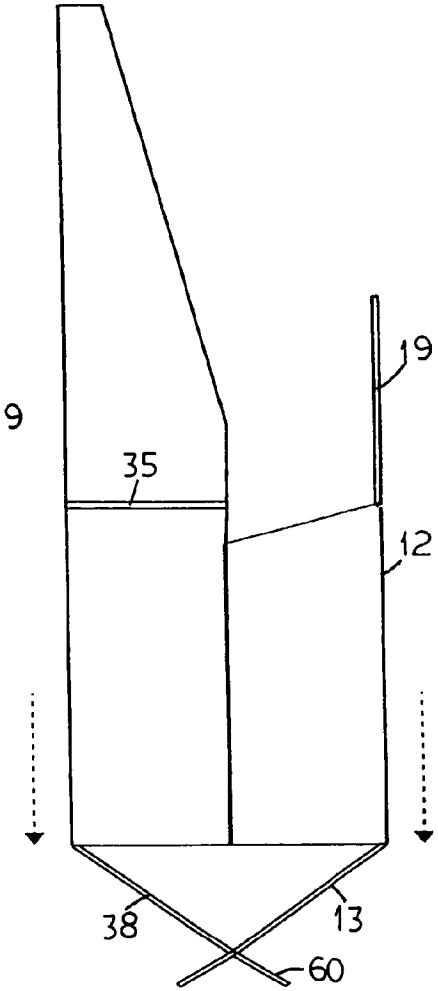
FIG. 6 is a side perspective view of the stand in the partially erected condition with the foldable brace pulled partially downwards and the pedestal panel is the unfolded upward position.
Figure 5:
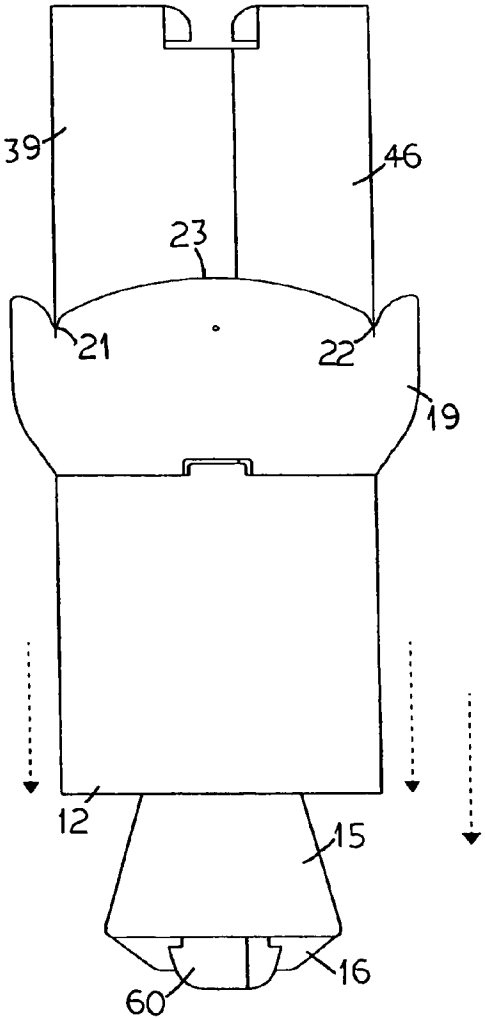
FIG. 5 is a perspective front view of the stand in a partially folded condition with the foldable brace pulled outward and downward, the side panels folded inwards, and the pedestal panel folded upwards to lie juxtaposed to the folded side panels.

An elastic cord 61 may be mounted between the free edge portion of the pedestal panel 19 and the rear panel of the stand as shown in FIG. 7 such that when the stand is in the collapsed condition, the elastic cord will be maintained in a tension condition. With this alternative construction, the stand in the collapsed folded condition may be quickly unfolded by merely holding the top of the left rear panel 36 and right rear panel 50 and raising and shaking the folded stand such that the elastic cord in tension would pull the pedestal panel 19 downward while the pivotal brace would unfold to force the side panels to return to the erected condition until the pedestal panel 19 is pulled back to the horizontal position with the open slots 21 and 22 engaging with the edges of the side panels to maintain the stand in the stable erected condition.

What is claimed is:

1. A foldable display support stand comprising:

a rectangular center front panel;

a pedestal panel extending upwardly from a top edge of said front panel and foldable relative to said front panel along said top edge of said front panel, two spaced open slots formed at a free edge of said pedestal panel and located distal from said top edge of said rectangular center front panel;

a left side panel having a left front side panel and a left rear side panel foldable relative to one another along a common left vertical fold line, and said left front side panel being foldable along a common vertical left side edge with said front panel, a right side panel having a right front side panel and a right rear side panel foldable relative to one another along a common right vertical fold line, said left side panel and said right side panel having a mirror image of one another;

a rear panel formed by engagement of a left rear end panel and a right rear end panel, said left rear end panel being foldable relative to said left rear side panel and said right rear end panel being foldable relative to said right rear side panel;

a pivotal brace formed by a trapezoidal front foldable panel connected and foldable to a lower edge of said front center panel, and a trapezoidal rear foldable panel connected and foldable to a lower edge of said rear panel; said trapezoidal rear foldable panel being formed by a left extension panel extending downwards from a left lower edge portion of said left rear end panel, and a right extension panel extending downwards from a right lower edge portion of said right rear end panel;

a left hook-shaped tab formed at a lower free edge of said left extension panel, and a right hook-shaped tab extending downwards from a right lower edge portion of said right rear end panel, said left hook-shaped tab and said right hook-shaped tab being engageable with one another to formed a trapezoidal tab;

a transverse slot formed in said trapezoidal front foldable panel; said transverse slot being engageable with said trapezoidal tab to form said pivotal brace.

2. A foldable display support stand according to claim 1 wherein said left rear side panel and said right rear side panel have a sloping upper front edge portion sloping upwardly and rearwardly.

3. A foldable display support stand according to claim 2 wherein said left side panel and said right side panel being foldable inwards towards one another until said front center panel lies juxtaposed to said rear panel to form said stand into a partially folded condition.

4. A foldable display support stand according to claim 3 wherein said foldable brace is operative to position in an extended horizontal manner for maintaining said stand in an erected condition, and said pivotal brace is foldable outward and downward to initiate and provide the folding operation of said stand to a folded collapsed condition.

5. A foldable display support stand according to claim 4 including a double horizontal fold line formed in said left front side panel and said right front side panel, a horizontal single fold line formed in said left rear side panel and said right rear side panel, said double horizontal fold line being aligned with said horizontal single fold line and said top edge of said center front panel, said stand in said folded collapsed condition being further foldable along said aligned double horizontal fold line, said horizontal single fold line and said top edge of said center front panel to a further folded condition for convenient storage and transportation.

6. A foldable display support stand according to claim 5 wherein said open slots at said free edge of said pedestal panel are engageable with front edges of said left front side panel and said right front side panel to locate said pedestal panel in a horizontal position and sloping rearwardly and downwardly for providing a platform to support a display item placed thereon.

7. A foldable display support stand according to claim 6 including an elastic cord connected between said rear panel and an edge portion of said free edge of said pedestal panel, said elastic cord being stretched in a tension condition when said stand is in said folded collapsed condition.

* * * * *